US011376724B2

(12) United States Patent
Lee et al.

(10) Patent No.: US 11,376,724 B2
(45) Date of Patent: Jul. 5, 2022

(54) MULTI-PURPOSE TOOL SYSTEM

(71) Applicant: ILLINOIS TOOL WORKS INC., Glenview, IL (US)

(72) Inventors: Joel R. Lee, Peotone, IL (US); Mark O. Lepper, Oak Park, IL (US)

(73) Assignee: Illinois Tool Works Inc., Glenview, IL (US)

( * ) Notice: Subject to any disclaimer, the term of this patent is extended or adjusted under 35 U.S.C. 154(b) by 796 days.

(21) Appl. No.: 16/098,691

(22) PCT Filed: Nov. 6, 2017

(86) PCT No.: PCT/US2017/060090

§ 371 (c)(1),
(2) Date: Nov. 2, 2018

(87) PCT Pub. No.: WO2018/111435

PCT Pub. Date: Jun. 21, 2018

(65) Prior Publication Data

US 2021/0237250 A1 Aug. 5, 2021

Related U.S. Application Data

(60) Provisional application No. 62/434,585, filed on Dec. 15, 2016.

(51) Int. Cl.
*B25F 1/02* (2006.01)

(52) U.S. Cl.
CPC ..... *B25F 1/02* (2013.01)

(58) Field of Classification Search
CPC ..... B25F 1/02
USPC ..... 7/164
See application file for complete search history.

(56) References Cited

U.S. PATENT DOCUMENTS 1,840,135 A * 1/1932 Schutt ..... B43M 7/002 7/164
6,076,665 A * 6/2000 Chuang ..... A45D 29/20 206/214
6,244,489 B1 * 6/2001 Laurie ..... B25C 5/025 227/134
6,460,698 B1 * 10/2002 Wang ..... B25F 1/02 206/234

(Continued)

FOREIGN PATENT DOCUMENTS

| | | | |
|---|---|---|---|
| CA | 2363769 | A1 | 5/2003 |
| EP | 1170094 | A2 | 1/2002 |
| WO | 2016005849 | A1 | 1/2016 |

OTHER PUBLICATIONS

International Search Report and Written Opinion, International Application No. PCT/US2017/060090 dated Feb. 21, 2018, 10 pages.

*Primary Examiner* — Anne M Kozak
*Assistant Examiner* — Jonathan G Santiago Martinez
(74) *Attorney, Agent, or Firm* — Quarles & Brady LLP

(57) ABSTRACT

A multi-purpose tool system (100) includes a first tool (104) that is configured to perform a first function, a second tool (106) that is configured to perform a second function, a third tool (140) that is configured to perform a third function, and a fourth tool (142) that is configured to perform a fourth function. The tools couple together to form a single, unitary handheld housing (102). Each of the tools is configured to separate from the housing for individual use.

19 Claims, 9 Drawing Sheets

(56) References Cited

U.S. PATENT DOCUMENTS

| | | | | |
|---|---|---|---|---|
| 6,874,189 | B2 * | 4/2005 | Ackeret | B25C 5/0214 7/160 |
| 2010/0263219 | A1 * | 10/2010 | Kempker | B25F 1/02 30/337 |

* cited by examiner

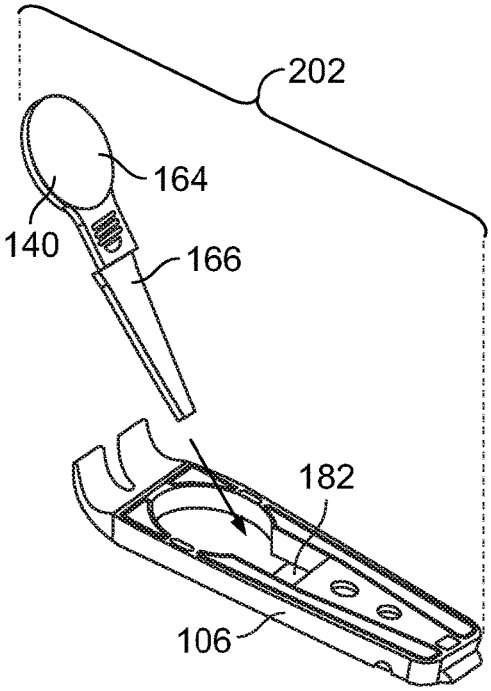
FIG. 13
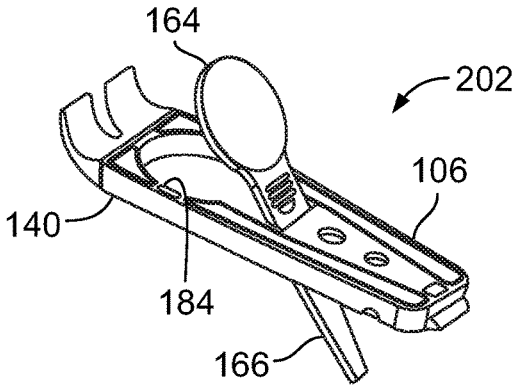
FIG. 14
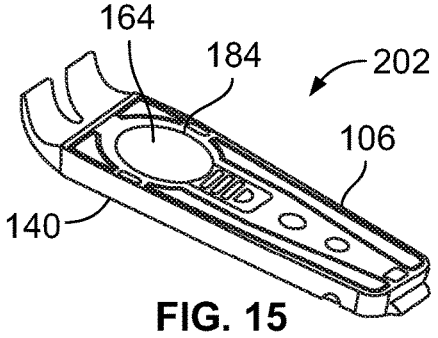
FIG. 15
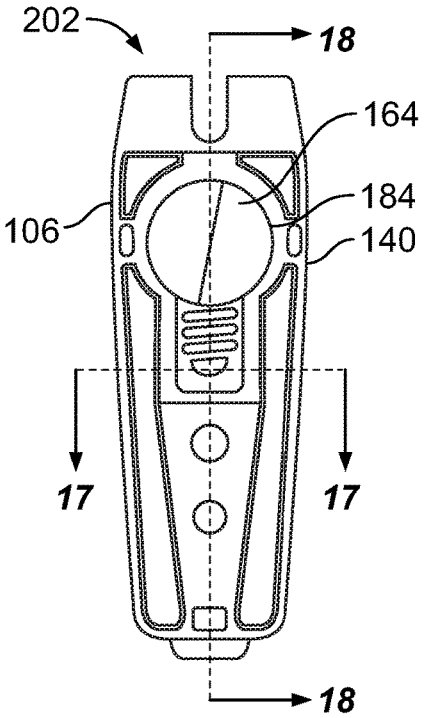
FIG. 16
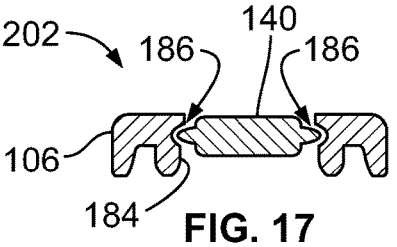
FIG. 17
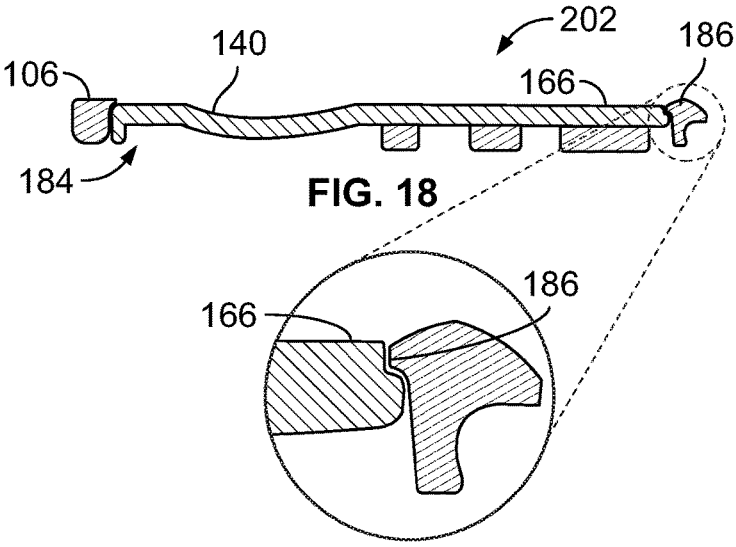
FIG. 18
FIG. 19

MULTI-PURPOSE TOOL SYSTEM

RELATED APPLICATIONS

This application represents the United States National Stage of International Application No. PCT/US2017/060090, filed Nov. 6, 2017, which claims priority to U.S. Provisional Patent Application No. 62/434,585, entitled "Multi-Purpose Tool System," filed Dec. 15, 2016, all of which are hereby incorporated by reference in their entirety.

FIELD OF EMBODIMENTS OF THE DISCLOSURE

Embodiments of the present disclosure generally relate to a multi-purpose tool system.

BACKGROUND

Currently, plastic fastener removal tools axe sold as single tools or multiples sets. As can be appreciated, the multiple tools are susceptible to being misplaced or lost. Further, the various tools of different shapes and sizes may be cumbersome to transport between different locations. Some tool sets include a specialized case that is used to organize the various tools. The case itself may be relatively large, bulky, and also cumbersome to transport between different locations.

U.S. Pat. Nos. 9,505,111, 7,735,806, and United States Published Application No. 2008/0127473 disclose tools.

SUMMARY OF EMBODIMENTS OF THE DISCLOSURE

A need exists for an efficient tool system that organizes and contains a plurality of tools within a single housing. A need exists for a versatile tool system that is compact and easy to transport.

With those needs in mind, certain embodiments of the present disclosure provide a multi-purpose tool system that includes a first tool that is configured to perform a first function, a second tool that is configured to perform a second function, a third tool that is configured to perform a third function, and a fourth tool that is configured to perform a fourth function. The tools couple together to form a single, unitary handheld housing. Further, tools are configured to separate from the housing for individual use.

In at least one embodiment, the first tool provides a base of the housing. The second tool removably secures to the second tool to provide a cover of the housing. An internal retaining chamber is formed in the first tool. One or both of the third tool and the fourth tool is configured to be retained within the retaining chamber.

One of tools may include a grip tool (for example, a prying tool). The grip tool may include ramped prongs separated by a central groove. The ramped prongs taper down to thin edges towards a distal end.

One of the tools may include a claw tool. The claw tool may include two arcuate pry claws separated by a gap.

One of the tools may include a magnifying tool. The magnifying tool may include a magnifying lens integrally connected to a support beam. In at least one embodiment, the support beam includes a plurality of gradations that are configured to be used for measurements.

One of the tools may include a pick tool. The pick tool may include an expanded end connected to a tip at an opposite end through inwardly angled or curved lateral walls, a top wall, and a bottom wall.

One of the second tool, the third tool, or the fourth tool may be configured to be retained within a reciprocal socket formed in a retaining chamber of the first tool.

In at least one embodiment, a first pair of two of the first tool, the second tool, the third tool, and the fourth tool removably couple together to form a first tool subassembly. A second pair of the other two of the first tool, the second tool, the third tool, and the fourth tool removably couple together to form a second tool subassembly. The first tool subassembly removably couples to the second tool subassembly.

At least one of the first tool, the second tool, the third tool, and the fourth tool may include a plurality of holes that are configured to measure diameters of components (such as diametrical bosses or protruding cylinders).

In at least one embodiment, at least two of the first tool, the second tool, the third tool, and the fourth tool are configured to separate from the housing and couple together to form a fifth tool that is configured to perform a fifth function. In at least one embodiment, the fifth tool provides a support stand.

BRIEF DESCRIPTION OF SEVERAL VIEWS OF THE DRAWINGS

FIG. 13 illustrates a perspective bottom view of a third tool separated from a second tool, according to an embodiment of the present disclosure.

FIG. 14 illustrates a perspective bottom view of a third tool being inserted into a central beam opening of a second tool, according to an embodiment of the present disclosure.

FIG. 15 illustrates a perspective bottom view of a third tool secured within a retaining cavity of a second tool, according to an embodiment of the present disclosure.

FIG. 16 illustrates a bottom view of a third tool secured within a retaining cavity of a second tool, according to an embodiment of the present disclosure.

FIG. 17 illustrates a cross-sectional view of a third tool secured within a retaining cavity of a second tool through line 17-17 of FIG. 16, according to an embodiment of the present disclosure.

FIG. 18 illustrates a cross-sectional view of a third tool secured within a retaining cavity of a second tool through line 18-18 of FIG. 16, according to an embodiment of the present disclosure.

FIG. 19 illustrates a cross-sectional view of a protuberance securely coupling to a peripheral portion of a third tool, according to an embodiment of the present disclosure.

Figure 1:
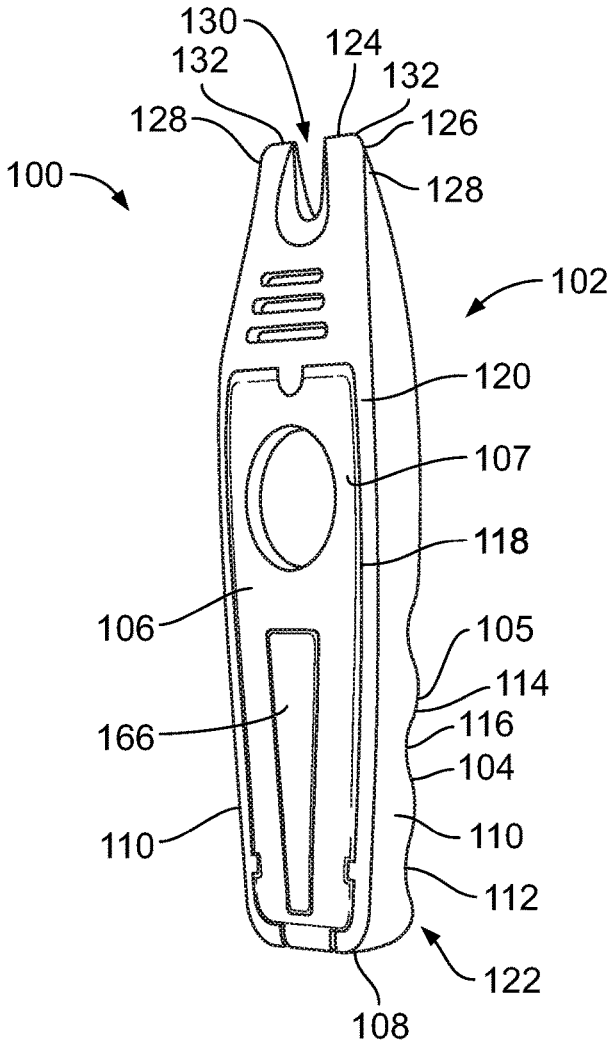
FIG. 1 illustrates a perspective top view of a multi-purpose tool system, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

Embodiments of the present disclosure provide a multi-purpose tool system that includes a self-contained tool set. In at least one embodiment, the tool system includes multiple separate and distinct tools that are configured to couple to one another to provide a single, self-contained package. Each tool in the set is configured to provide separate functionality, and when coupled together, easily fit into a pocket of a bag or clothing for easy and simple transport.

Certain embodiments of the present disclosure relate to fastener removal tools and more specifically to tool kits and tool sets that allow for removal of various trim fasteners, moldings and door trim panels with various types of fastening schemes, shapes and created with multiple materials, such as those found in motor vehicles.

In at least one embodiment, a first tool includes a magnifying lens with integrated hole measuring device. The first tool allows for quick measuring of a range of common hole sizes and a magnifying lens at the opposite end for viewing features on small fasteners or components.

In at least one embodiment, a second tool includes a claw tool with integrated common measuring device. The second tool is configured to provide maximum leverage for trim or fastener removal along with quick measuring of common stud sizes.

In at least one embodiment, a third tool includes a grip tool that allows for removal of fasteners without causing damage to mating trim panels and at the same time designed to contain the other tools within it without affecting functionality. The grip tool and the claw tool may be assembled together to provide another tool that is configured to support items such as a cell phone or picture frame.

All of the tools may couple together (such as through snap connections) to form a single pocket sized tool kit. Each tool within the kit performs specific functions.

To the extent used in the present application, the terms "first," "second," and "third," etc. are used merely as labels, and are not intended to impose numerical requirements on their objects. For example, the first tool may be a second tool, or vice versa.

Figure 2:
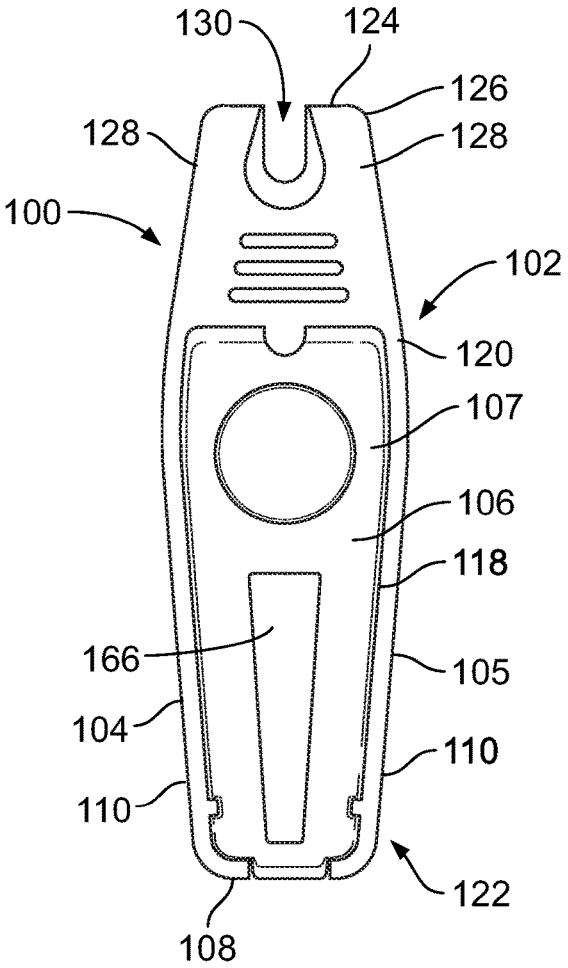
FIG. 2 illustrates a top view of a multi-purpose tool system, according to an embodiment of the present disclosure.
Figure 3:
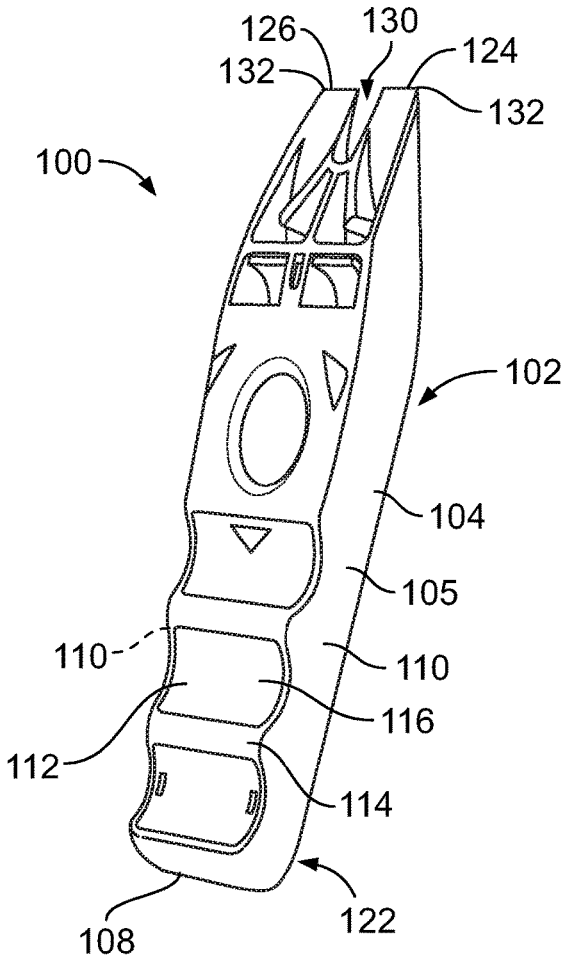
FIG. 3 illustrates a perspective bottom view of a multi-purpose tool system, according to an embodiment of the present disclosure.
Figure 4:
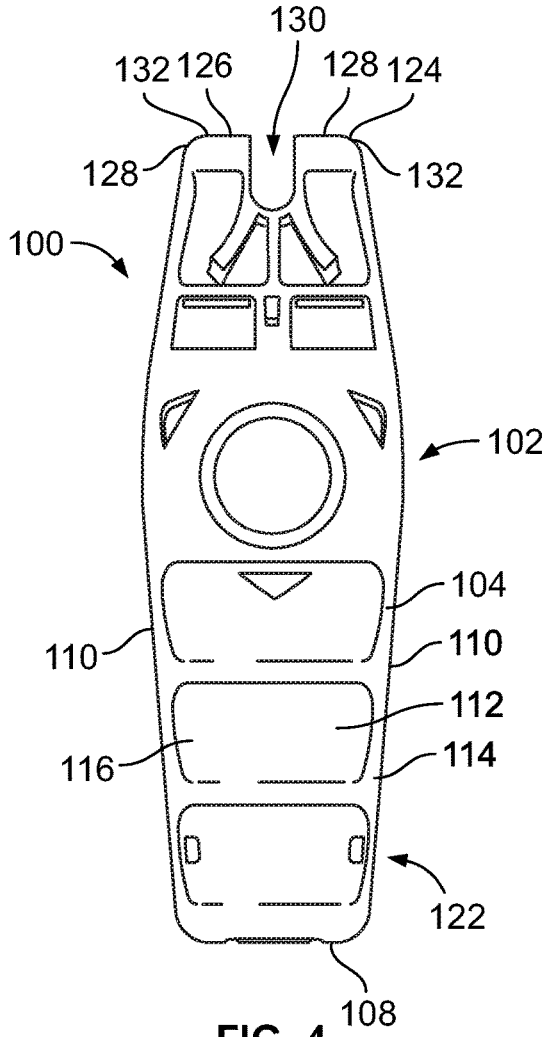
FIG. 4 illustrates a bottom view of a multi-purpose tool system, according to an embodiment of the present disclosure.
Figure 5:
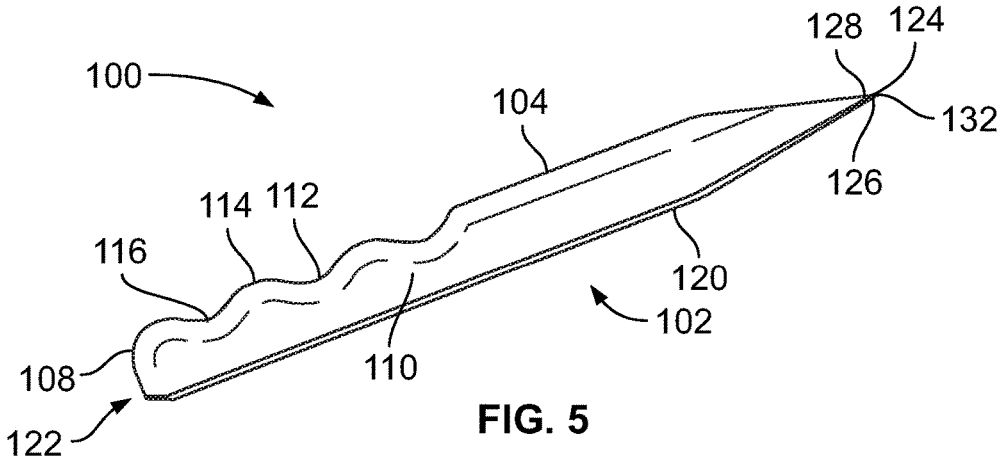
FIG. 5 illustrates a lateral view of a multi-purpose tool system, according to an embodiment of the present disclosure.

FIG. 1 illustrates a perspective top view of a multi-purpose tool system 100, according to an embodiment of the present disclosure. FIG. 2 illustrates a top view of the multi-purpose tool system 100. FIG. 3 illustrates a perspective bottom view of the multi-purpose tool system 100. FIG. 4 illustrates a bottom view of the multi-purpose tool system 100. FIG. 5 illustrates a lateral view of the multi-purpose tool system 100.

Referring to FIGS. 1-5, the multi-purpose tool system 100 includes a compact housing 102 formed by a first tool 104 (shown in FIGS. 1-5) that provides a base 105 of the housing 102, and a second tool 106 (shown in FIGS. 1 and 2) that provides a cover 107 of the housing 102. The second tool 106 removably secures to the first tool 104, such as through a snapable connection. When the second tool 106 is coupled to the first tool 104, the second tool 106 provides the cover 107 over an internal chamber that retains additional tools, as described herein.

The first tool 104 is a grip tool (such as a prying tool) that includes a proximal end wall 108 connected to lateral walls 110 and a bottom wall 112 having a plurality of tactile features, such as gripping peaks 114 and valleys 116. An internal retaining chamber 118 (shown in FIGS. 1 and 2) is recessed into a top wall 120 of the first tool 104. The second tool 106 securely fits within the retaining chamber 118 when the second tool 106 is securely coupled to the first tool 104. A handle 122 for the first tool 104 is formed by the proximal end wall 108, the lateral walls 110, the bottom wall 112, and the top wall 120, whether or not the second tool 106 is secured within the retaining chamber 118.

The first tool 104 also includes an operative member 124 at a distal end 126 that is opposite from the proximal end wall 108. The operative member 124 includes mirrored ramped prongs 128 separated by a central groove 130. The ramped prongs 128 taper down to thin edges 132 towards the distal end 126.

Figure 6:
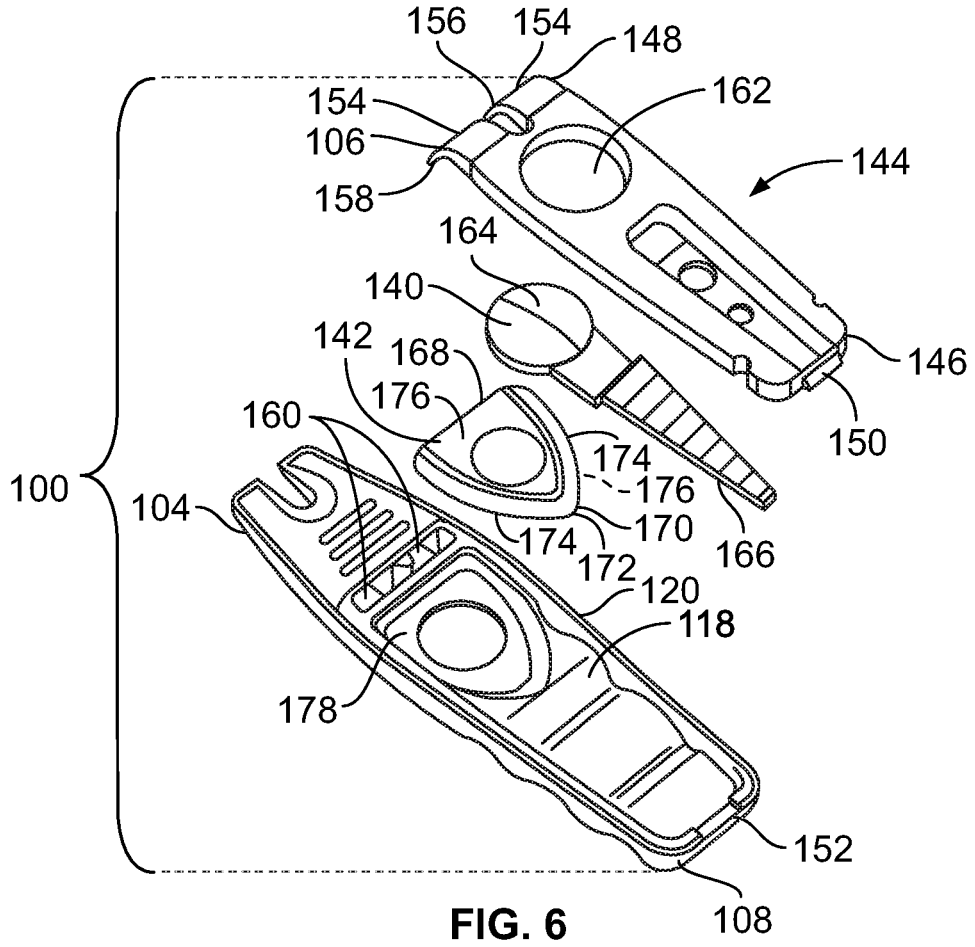
FIG. 6 illustrates a perspective top exploded view of a multi-purpose tool system, according to an embodiment of the present disclosure.

FIG. 6 illustrates a perspective top exploded view of the multi-purpose tool system 100, according to an embodiment of the present disclosure. The multi-purpose tool system 100 includes the first tool 104 (such as a grip tool), the second tool 106 (such as claw tool), a third tool 140 (such as a magnifying tool), and a fourth tool 142 (such as a pick tool). As shown, the retaining chamber 118 is recessed into the top wall 120 of the first tool 118. The second tool 106 is configured to secure over the retaining chamber 118 in a secured connecting position.

The second tool 106 includes a main body 144 having a proximal end 146 connected to an operative distal end 148, The proximal end 146 includes a tab 150 that is configured to fit into a slot 152 formed in the proximal end wall 108 of the first tool 104. Optionally, the second tool 106 may include the slot 152, while the first tool 104 includes the tab 150.

The operative distal end 148 includes two arcuate claws 154 separated by a gap 156. The claws 154 include tips 158 that downwardly curve toward the first tool 104 (as shown in FIG. 6). The claws 154 are configured to be retained within reciprocal channels 160 formed in the first tool 104. In order to secure the second tool 106 to the first tool 104, the claws 154 may be urged into the channels 160, and the distal end 148 of the second tool 106 may be pivoted hack about the interfaces between the claws 154 and the channels 160 and secured within the slot 152 formed in the proximal end 108 of the first tool 104. In order to remove the second tool 106 from the first tool 104 (and thereby expose the retaining chamber 118), an individual may grasp the tab 150, and upwardly urge the second tool 106 away from the first tool 104.

As shown, the second tool 106 may also include a passage 162 formed through the main body 144 proximate to the operative distal end 148, The round passage 162 is configured to expose a magnifying lens 164 of the third tool 140 when the third tool 140 is retained within the retaining chamber 118 of the first tool 104 and covered by the second tool 106. Optionally, the second tool 106 may not include the round passage 162.

The third tool 140 includes the magnifying lens 164 (such as formed of transparent glass or plastic) integrally connected to a support beam 166. The third tool 140 is configured to be retained within the retaining chamber 118 of the first tool 104 and covered by the second tool 106.

The fourth tool 142 includes an expanded end 168 connected to a tip 170 at an opposite end 172 through inwardly angled or curved lateral walls 174, a top wall 176, and a bottom wall 178, thereby forming a pick. The fourth tool 142 is configured to nest within a reciprocal socket 178 formed in the retaining chamber 118 of the first tool 104.

As described herein, the first tool 104, the second tool 106, the third tool 140, and the fourth tool 142 coupled together to form the single, unitary, handheld housing 102 that may be easily transported. For example, the single, unitary, handheld housing 102 may fit into a pants pocket. The first tool 104, the second tool 106, the third tool 140, and the fourth tool 142 are configured to separate from the housing 102 and/or one another for individual use. Further, in at least one embodiment, at least two of the first tool 104, the second tool 106, the third tool 140, and the fourth tool 142 may be coupled together to form a fifth tool.

The first tool 104 is configured to perform a first function (such as gripping, prying, and/or pulling), the second tool 106 is configured to perform a second function (such as clawing, prying, and/or pulling) the third tool 140 is configured to perform a third function (such as magnifying and/or measuring), and the fourth tool 142 is configured to perform a fourth function (such as picking and prying). Each of the first, second, third, and fourth functions may differ from one another.

It is to be understood that the terms first, second, third, and fourth in relation to the tools are merely to indicate a number of tools within the multi-purpose tool system 100. The first tool may optionally be the second, third, or fourth tool. The second tool may optionally be the first, third, or fourth tool. The third tool may optionally be the first, second, or fourth tool. The fourth tool may optionally be the first, second, or third tool. Moreover, the tools may be different than a grip tool, a claw tool, a magnifying tool, and a pick tool. For example, one of the tools may be a wrench tool, a hammer tool, a clip tool, a screwdriver tool, and/or the like.

Figure 7:
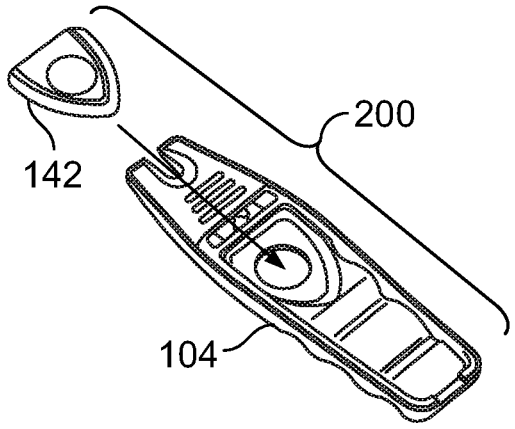
FIG. 7 illustrates a perspective top view of a fourth tool separated from a first tool, according to an embodiment of the present disclosure.
Figure 8:
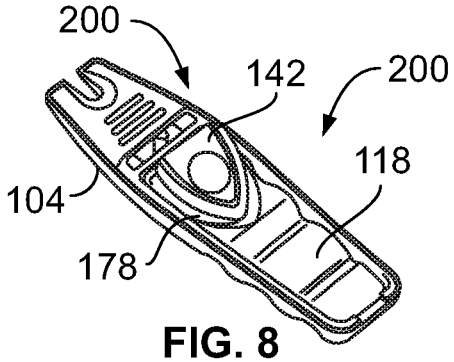
FIG. 8 illustrates a perspective top view of a fourth tool being inserted into a socket of a retaining chamber of a first tool, according to an embodiment of the present disclosure.
Figure 9:
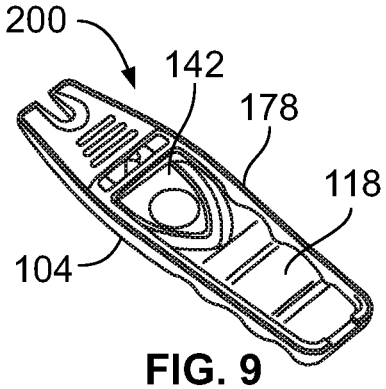
FIG. 9 illustrates a perspective top view of a fourth tool secured within a socket of a retaining chamber of a first tool, according to an embodiment of the present disclosure.
Figure 10:
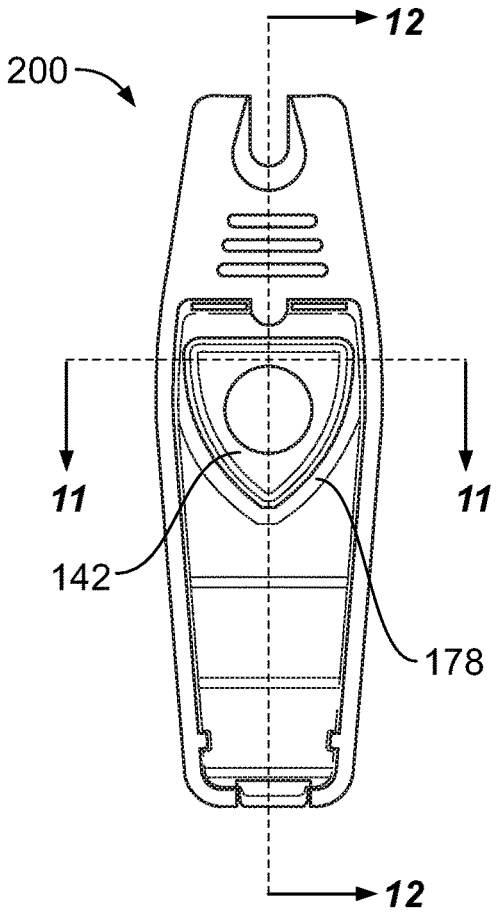
FIG. 10 illustrates a top view of a fourth tool secured within a socket of a retaining chamber of a first tool, according to an embodiment of the present disclosure.
Figure 11:
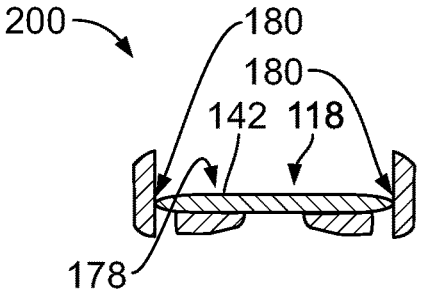
FIG. 11 illustrates a cross-sectional view of a fourth tool secured within a socket of a retaining chamber of a first tool through line 11-11 of FIG. 10, according to an embodiment of the present disclosure.
Figure 12:
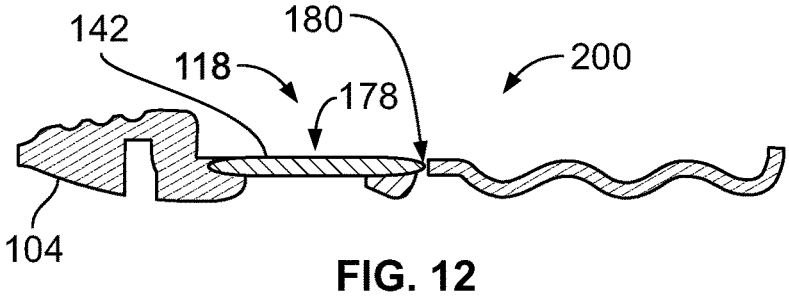
FIG. 12 illustrates a cross-sectional view of a fourth tool secured within a socket of a retaining chamber of a first tool through line 12-12 of FIG. 10, according to an embodiment of the present disclosure.

FIG. 7 illustrates a perspective top view of the fourth tool 142 separated from the first tool 104. FIG. 8 illustrates a perspective top view of the fourth tool 142 being inserted into the socket 178 of the retaining chamber 118 of the first tool 104. FIG. 9 illustrates a perspective top view of the fourth tool 142 secured within the socket 178 of the retaining chamber 118 of the first tool 104. FIG. 10 illustrates a top view of the fourth tool 142 secured within the socket 178 of the retaining chamber 118 of the first tool 104. FIG. 11 illustrates a cross-sectional view of the fourth tool 142 secured within the socket 178 of the retaining chamber 118 of the first tool 104 through line 11-11 of FIG. 10. FIG. 12 illustrates a cross-sectional view of the fourth tool 142 secured within the socket 178 of the retaining chamber 118 of the first tool 104 through line 12-12 of FIG. 10.

Referring to FIGS. 7-12, in order to assemble the multi-purpose tool system 100 (shown in FIGS. 1-6), the fourth tool 142 may first be secured to the first tool 104. For example, the fourth tool 142 (such as a pick tool) may first be angularly inserted into the socket 178 of first tool 104 (such as a grip tool), as shown in FIG. 7, and then pushed down into the socket 178 until protuberances 180 (such as resilient clasps, ledges, barbs, ramps, and/or the like) snapably engage outer peripheral portions of the fourth tool 142. In order to remove the fourth tool 142 from the first tool 104, an individual gasps a portion of the fourth tool 142, and pivots or otherwise urges the fourth tool 142 out of the socket 178 to overcome the retaining three of the protuberances 180.

FIG. 13 illustrates a perspective bottom view of the third tool 140 separated from the second tool 106. FIG. 14 illustrates a perspective bottom view of the third tool 140 being inserted into a central beam opening 182 of the second tool 106. FIG. 15 illustrates a perspective bottom view of the third tool 140 secured within a retaining cavity 184 of the second tool 106. FIG. 16 illustrates a bottom view of the third tool 140 secured within the retaining cavity 184 of the second tool 106. FIG. 17 illustrates a cross-sectional view of the third tool 140 secured within the retaining cavity 184 of the second tool 106 through line 17-17 of FIG. 16. FIG. 18 illustrates a cross-sectional view of the third tool 140 secured within the retaining cavity 184 of the second tool 106 through line 18-18 of FIG. 16.

Referring to FIGS. 13-18, the support beam 166 of the third tool 140 (such as a magnifying tool) is inserted angularly into the central beam opening 182 of the second tool 106. The magnifying lens 164 is then pivoted back so that the third tool 140 166 is retained within the retaining cavity 184 (such that at least a portion of the support beam 166 is exposed through the top of the second tool 106, as shown in FIGS. 1 and 2, for example). The second tool 106 may include protuberances 186 (such as resilient clasps, ledges, barbs, ramps, and/or the like) that snapably engage peripheral portions of the third tool 140, in order to securely couple the third tool 140 to the second tool 106. FIG. 19 illustrates a cross-sectional view of a protuberance 186 securely coupled to a peripheral portion of the third tool 140 (such as an end of the support beam 166), according to an embodiment of the present disclosure.

Referring to FIGS. 7-18, after the fourth tool 142 is securely coupled to the first tool 104, and the third tool 140 is securely coupled to the second tool 106, a first tool subassembly 200 (shown in FIGS. 7-12) including a first pair of tools coupled together (such as the first tool 104 and the fourth tool 142) may be secured to a second tool subassembly 202 (shown in FIGS. 13-18) including a second pair of tool coupled together (such as the second tool 106 and the third tool 140) to form a single, unitary, compact multi-purpose tool system 100.

Figure 20:
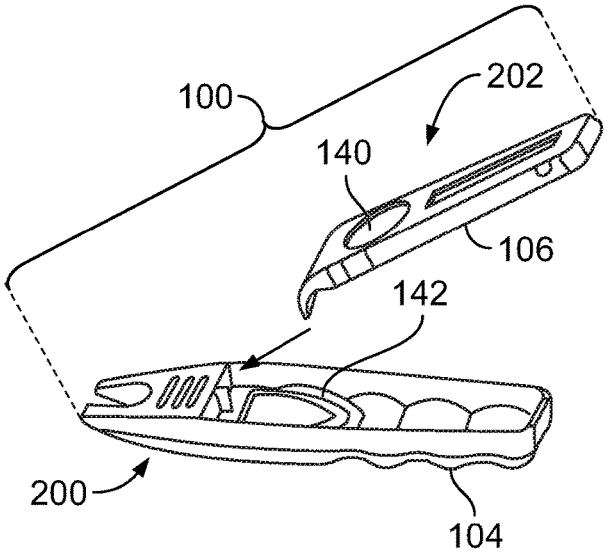
FIG. 20 illustrates a perspective top view of a first tool subassembly separated from a second tool subassembly, according to an embodiment of the present disclosure.
Figure 21:
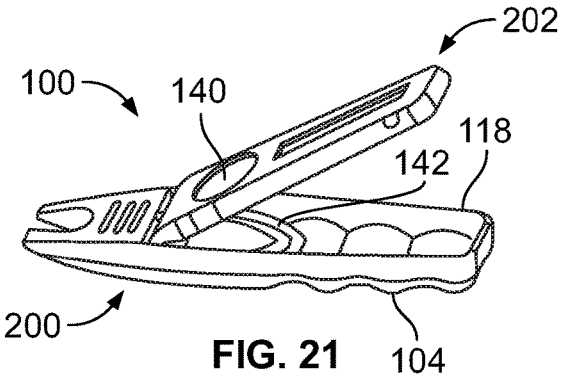
FIG. 21 illustrates a perspective top view of a second tool subassembly being inserted over a retaining chamber of a first tool of the first tool subassembly, according to an embodiment of the present disclosure.
Figure 22:
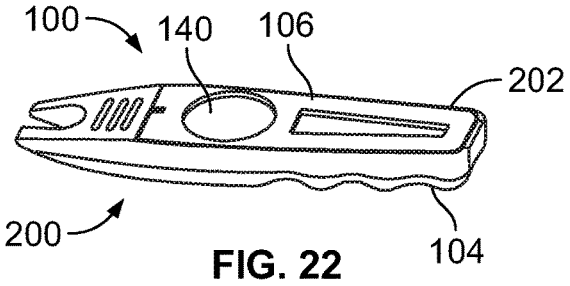
FIG. 22 illustrates a perspective top view of a second tool subassembly secured to the first tool subassembly, according to an embodiment of the present disclosure.
Figure 23:
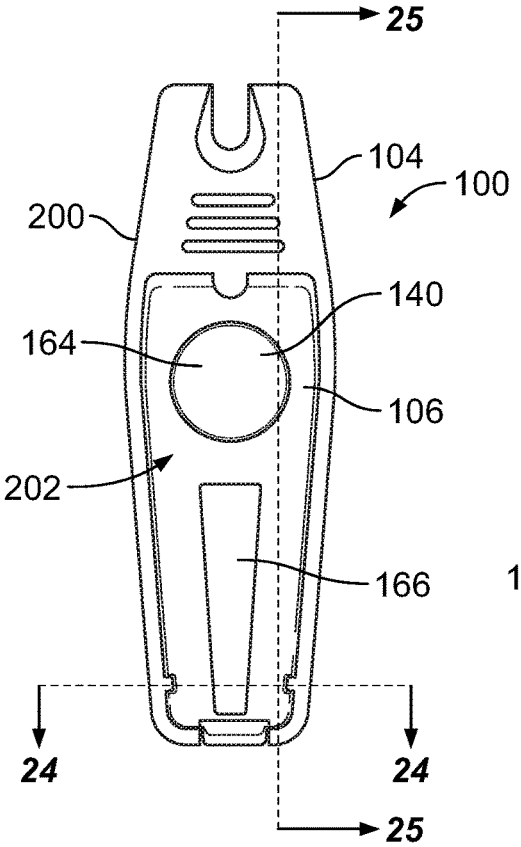
FIG. 23 illustrates a top view of a second tool subassembly secured to the first tool subassembly, according to an embodiment of the present disclosure.
Figure 24:
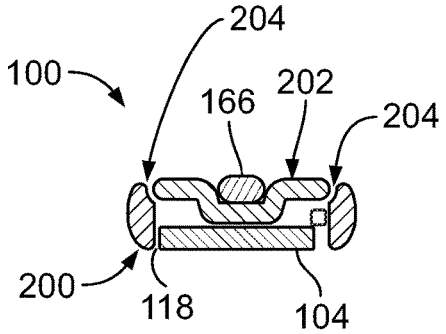
FIG. 24 illustrates a cross-sectional view of a second tool subassembly secured over a retaining chamber of a first tool of a first tool subassembly through line 24-24 of FIG. 23, according to an embodiment of the present disclosure.
Figure 25:
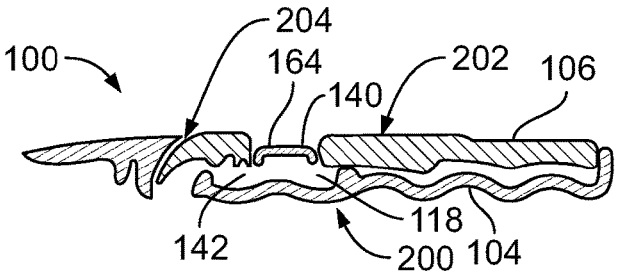
FIG. 25 illustrates a cross-sectional view of a second tool subassembly secured over a retaining chamber of a first tool of a first tool subassembly through line 25-25 of FIG. 23, according to an embodiment of the present disclosure.

FIG. 20 illustrates a perspective top view of the first tool subassembly 200 separated from the second tool subassembly 202. FIG. 21 illustrates a perspective top view of the second tool subassembly 202 being inserted over the retaining chamber 118 (in which the fourth tool 142 is already secured) of the first tool 104 of the first tool subassembly 200. FIG. 22 illustrates a perspective top view of the second tool subassembly 202 secured to the first tool subassembly 200. FIG. 23 illustrates a top view of the second tool subassembly 202 secured to the first tool subassembly 200. FIG. 24 illustrates a cross-sectional view of the second tool subassembly 202 secured over the retaining chamber 118 of the first tool 104 of the first tool subassembly 200 through line 24-24 of FIG. 23. FIG. 25 illustrates a cross-sectional view of the second tool subassembly 202 secured over the retaining chamber 118 of the first tool 104 of the first tool subassembly 200 through line 25-25 of FIG. 23.

Referring to FIGS. 20-25, the second tool subassembly 202 is inserted angularly into the first tool subassembly 200, and then pushed downwardly into the first tool subassembly 200 until protuberances 204 (such as resilient clasps, ledges, barbs, ramps, and/or the like) of the first tool subassembly 200 snapably secure to peripheral portions of the second tool subassembly 202. As shown and described, the first tool subassembly 200 securely couples to the second tool subassembly 202 to provide a single, compact, convenient housing that securely couples a plurality of tools (such as the first tool 104, the second tool 106, the third tool 140, and the fourth tool 142) together, thereby forming the unitary multi-purpose tool system 100.

Figure 26:
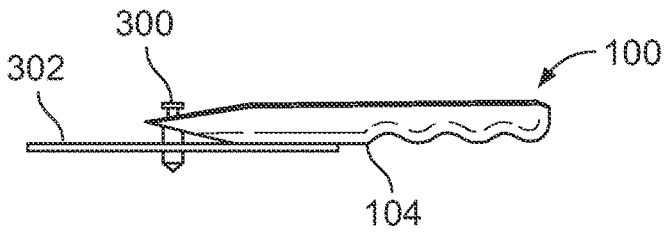
FIG. 26 illustrates a lateral view of a first tool removing a fastener from a panel, according to an embodiment of the present disclosure.

FIG. 26 illustrates a lateral view of the first tool 104 removing a fastener 300 from a panel 302, according to an embodiment of the present disclosure. As noted, the first tool 104 may be a grip tool that may be used for fastener removal.

Figure 27:
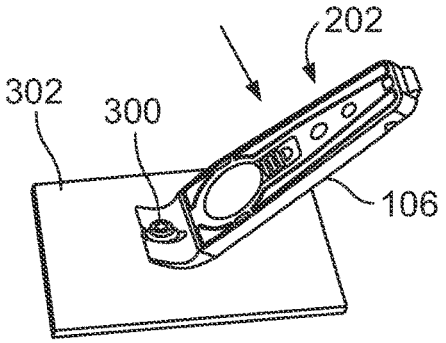
FIG. 27 illustrates a perspective view of a second tool removing a fastener from a panel, according to an embodiment of the present disclosure.

FIG. 27 illustrates a perspective view of the second tool 106 removing the fastener 300 from the panel 302, according to an embodiment of the present disclosure. The second tool subassembly 202 may be removed from the first tool subassembly 200 in order for the second tool 106 to be utilized. When higher forces or leverage are needed, the second tool 106, such as a claw tool may be used.

Figure 28:
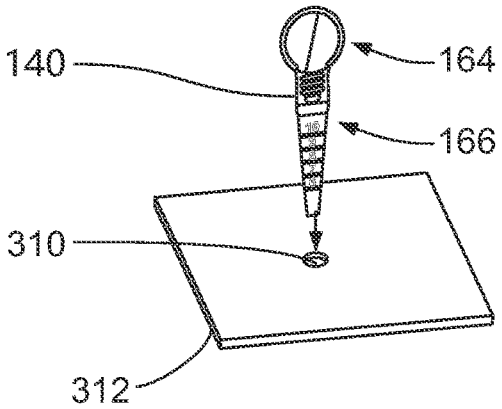
FIG. 28 illustrates a third tool being inserted into a hole of a panel, according to an embodiment of the present disclosure.

FIG. 28 illustrates the third tool 140 being inserted into a hole 310 of a panel 312, according to an embodiment of the present disclosure. In order to utilize the third tool 140, the second tool subassembly 202 (shown in FIGS. 13-17) is removed from the first tool subassembly 200 (shown in FIGS. 7-12), and the third tool 140 is then removed from the second tool 106 (shown in FIG. 27). The third tool 140 may provide a magnifying tool including the magnifying lens 164 and the support beam 166. The support beam 166 may be used as a handle, or it may be inserted into the hole 310 to provide a stable connection for the magnifying lens 164 in relation to the panel 312, and may conveniently be used for measurement purposes.

Figure 29:
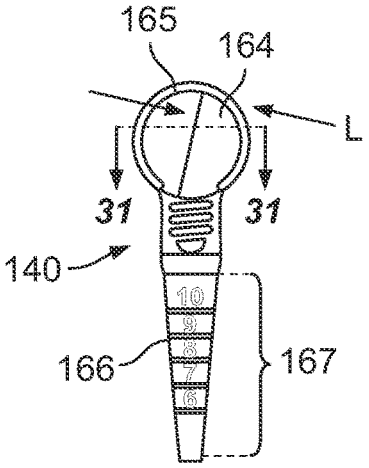
FIG. 29 illustrates a front view of a third tool, according to an embodiment of the present disclosure.
Figure 30:
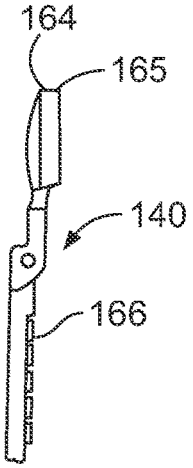
FIG. 30 illustrates a lateral view of a third tool, according to an embodiment of the present disclosure.
Figure 31:
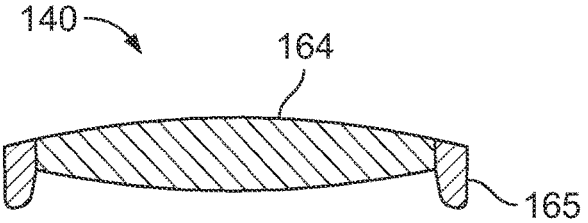
FIG. 31 illustrates a cross-sectional view of a magnifying lens of a third tool through line 31-31 of FIG. 29, according to an embodiment of the present disclosure.

FIG. 29 illustrates a front view of the third tool 140. FIG. 30 illustrates a lateral view of the third tool 140. FIG. 31 illustrates a cross-sectional view of the magnifying lens 164 of the third tool 140 through line 31-31 of FIG. 29. Referring to FIGS. 29-31, a protective ring 165 may surround the magnifying lens 164, which protects the magnifying lens 164, such as when disconnected from the second tool subassembly 202 (shown in FIGS. 13-18). The protective ring 165 provides a barrier that prevents objects from contacting the magnifying lens 164, thereby reducing a possibility of scratches thereto. The support beam 166 may include a plurality of gradations 167 that are configured to be used for measurements, for example.

Figure 32:
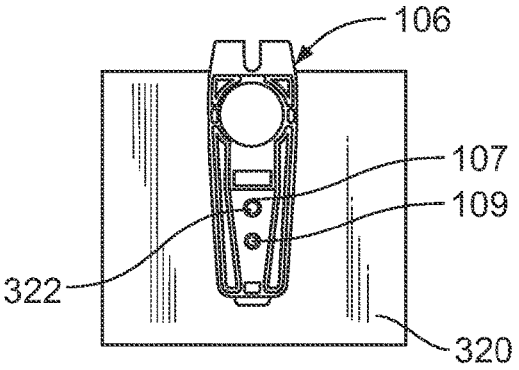
FIG. 32 illustrates a second tool positioned on a component panel, according to an embodiment of the present disclosure.

FIG. 32 illustrates the second tool 106 positioned on a component panel 320. The second tool 106 may also include a plurality of holes, such as holes 107 and 109, formed through a portion thereof. The holes 107 and 109 allow for measuring of component diameters (such as diametrical studs, bosses, or other such protruding cylinders). For example, the holes 107 and 109 may have different diameters and may be configured to fit around various studs, such as stud 322, to determine diameters of the studs.

Figure 33:
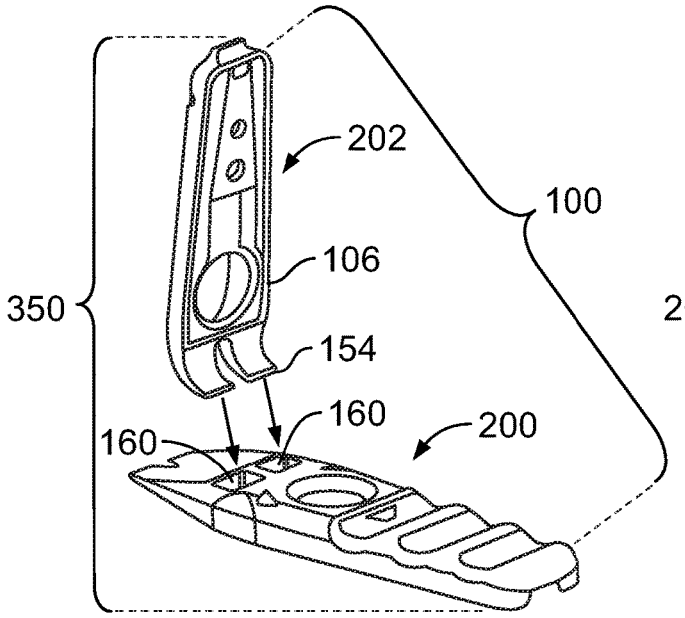
FIG. 33 illustrates a perspective top view of a second tool subassembly separated from a first tool subassembly before forming a fifth tool, according to an embodiment of the present disclosure.
Figure 34:
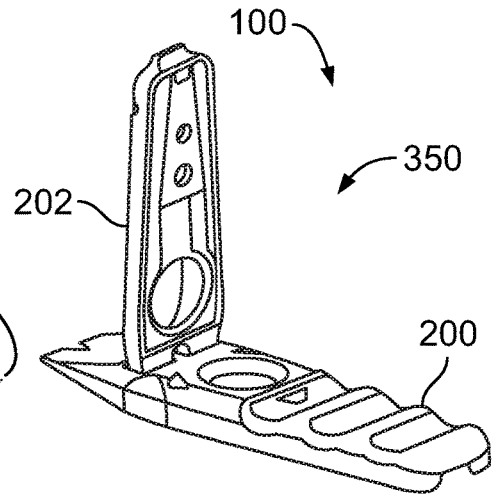
FIG. 34 illustrates a perspective top view of a second tool subassembly secured to a first tool subassembly to form a fifth tool, according to an embodiment of the present disclosure.
Figure 35:
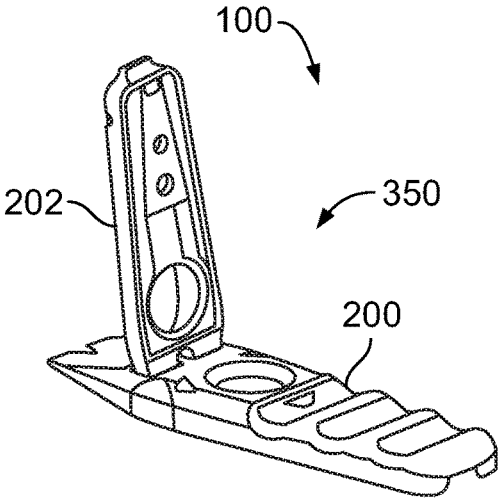
FIG. 35 illustrates a perspective top view of a fifth tool, according to an embodiment of the present disclosure.
Figure 36:
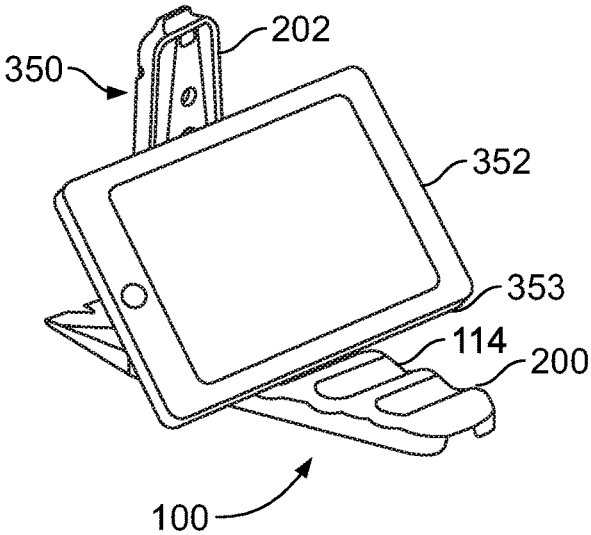
FIG. 36 illustrates a perspective top view of a fifth tool supporting a device, according to an embodiment of the present disclosure.

FIG. 33 illustrates a perspective top view of the second tool subassembly 202 separated from the first tool subassembly 200 before forming a fifth tool 350, according to an embodiment of the present disclosure. FIG. 34 illustrates a perspective top view of the second tool subassembly 202 secured to the first tool subassembly 200 to form the fifth tool 350. FIG. 35 illustrates a perspective top view of the fifth tool 350. FIG. 36 illustrates a perspective top view of the fifth tool 350 supporting a device (such as a smart phone, tablet, or the like), according to an embodiment of the present disclosure.

Referring to FIGS. 33-36, the first tool assembly 200 and the second tool assembly 202 may be connected together to form the fifth tool 350, such as a support stand. In order to form the fifth tool 350, the first tool assembly 200 and the second tool assembly 202 are disconnected from the compact, retaining housing state as shown in FIGS. 1-5, for example. Then, the first tool 200 is laid on a surface such that the retaining chamber 118 (shown in FIG. 6, for example) is face down on the surface and the gripping peaks 114 and valleys 116 are exposed in an upright position.

The claws 154 of the second tool 106 are then inserted into the channels 160 of the first tool 104 from an opposite side than as shown in FIG. 6. The curved nature of the claws 154 allows the second tool subassembly 202 to recline back with respect to the first tool subassembly 200 into the supporting position shown in FIGS. 35 and 36. The peaks 114 provide different supporting positions for a lower edge 353 of the device 352, thereby allowing the device 352 to be supported between the first tool subassembly 200 and the second tool subassembly 202 at different angular positions.

Figure 37:
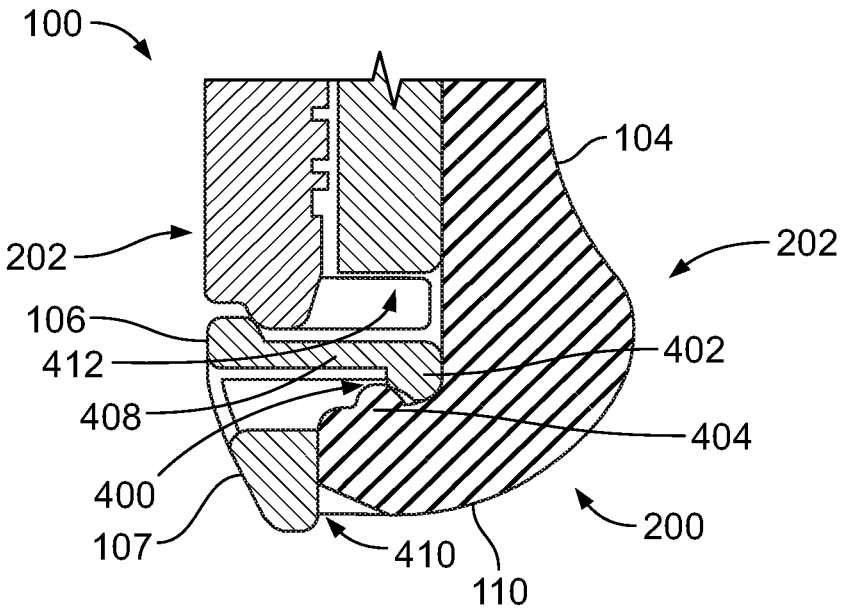
FIG. 37 illustrates a cross-sectional view of a distal end of a multi-purpose tool system, according to an embodiment of the present disclosure.

FIG. 37 illustrates a cross-sectional view of a distal end of the multi-purpose tool system 100, according to an embodiment of the present disclosure. In this embodiment, the first tool subassembly 200 including the first tool 104 removably secures to the second tool subassembly 202 including the second tool 106 at the distal end through a securing interface 400. The securing interface 400 at the distal end may be the only securing interface within the multi-purpose tool system.

The second tool 106 may include a resilient latch 402 or other such feature that snapably, latchably or otherwise removably secures to a reciprocal retainer 404 of the first tool 104. When a force is applied to the second tool 106 in the direction of arrow 410, the latch 402 moves past the retainer 404 in response to a resilient beam 408 connected to the latch 402 moving in the direction of arc 412, thereby allowing the first tool subassembly 200 to be separated from the second tool subassembly 202.

As described herein, embodiments of the present disclosure provide a multi-purpose tool system 100 that includes a plurality of separate and distinct tools (such as the tools 104, 106, 140, 142, and 350) that couple together to provide a single, unitary, and compact assembly that may be easily transported between locations.

Embodiments of the present disclosure provide an efficient tool system that organizes and contains a plurality of tools within a single housing. Further, embodiments of the present disclosure provide a versatile tool system that is compact and easy to transport.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

The invention claimed is:

1. A multi-purpose tool system, comprising:

a first tool that is configured to perform a first function;

a second tool that is configured to perform a second function;

a third tool that is configured to perform a third function; and a fourth tool comprising a pick tool defining outer peripheral portions, wherein the first tool, the second tool, the third tool, and the fourth tool couple together to form a single, unitary handheld housing, wherein the first tool, the second tool, the third tool, and the fourth tool are configured to separate from the housing, via snapable connections, for individual use, and wherein the first tool includes a reciprocal socket dimensioned to receive the fourth tool and snapably secure the fourth tool within the reciprocal socket via engagement of protuberances with the outer peripheral portions.

2. The multi-purpose tool system of claim 1, wherein the first tool provides a base of the housing, the first tool including a channel formed therein, wherein the second tool removably secures to the first tool to provide a cover of the housing, the second tool including at least one arcuate claw, wherein the channel is dimensioned to receive the at least one arcuate claw and the arcuate claw is configured to pivot within the channel, wherein an internal retaining chamber is formed in the first tool, and wherein one or both of the third tool and the fourth tool is configured to be retained within the retaining chamber.

3. The multi-purpose tool system of claim 1, wherein one of the first tool, the second tool, the third tool, and the fourth tool comprises a grip tool.

4. The multi-purpose tool system of claim 3, wherein the grip tool comprises mirrored ramped prongs separated by a central groove, wherein the ramped prongs taper down to thin edges towards a distal end.

5. The multi-purpose tool system of claim 1, wherein one of the first tool, the second tool, the third tool, and the fourth tool comprises a claw tool.

6. The multi-purpose tool system of claim 5, wherein the claw tool comprises two arcuate pry claws separated by a gap.

7. The multi-purpose tool system of claim 1, wherein one of the first tool, the second tool, the third tool, and the fourth tool comprises a magnifying tool.

8. The multi-purpose tool system of claim 7, wherein the magnifying tool comprises a magnifying lens integrally connected to a support beam.

9. The multi-purpose tool system of claim 8, wherein the support beam comprises a plurality of gradations that are configured to be used for measurements.

10. The multi-purpose tool system of claim 1, wherein the pick tool comprises an expanded end connected to a tip at an opposite end through inwardly angled or curved lateral walls, a top wall, and a bottom wall.

11. The multi-purpose tool system of claim 1, wherein one of the second tool, the third tool, or the fourth tool is configured to be retained within a reciprocal socket formed in a retaining chamber of the first tool.

12. The multi-purpose tool system of claim 1, wherein a first pair of two of the first tool, the second tool, the third tool, and the fourth tool removably couple together to form a first tool subassembly that includes protuberances, wherein a second pair of the other two of the first tool, the second tool, the third tool, and the fourth tool removably couple together to form a second tool subassembly that defines a peripheral portion, and wherein the protuberances of the first tool subassembly are configured to snapably engage the peripheral portion of the second tool subassembly to removably couple the first tool subassembly to the second tool subassembly.

13. The multi-purpose tool system of claim 1, wherein at least one of the first tool, the second tool, the third tool, and the fourth tool comprises a plurality of holes that are configured to measure component diameters.

14. The multi-purpose tool system of claim 1, wherein at least two of the first tool, the second tool, the third tool, and the fourth tool are configured to separate from the housing and couple together to form a fifth tool that is configured to perform a fifth function.

15. The multi-purpose tool system of claim 14, wherein the fifth tool provides a support stand for a device, the support stand including the second tool secured to and reclined back relative to the first tool, the first tool including gripping peaks and valleys configured to provide different supporting positions for the device.

16. A multi-purpose tool system, comprising:

a first tool including a channel formed therein and a retaining chamber, the first tool configured to perform a first function;

a second tool including at least one arcuate claw dimensioned to pivot within the channel, the second tool configured to perform a second function;

a third tool that is configured to perform a third function; and a fourth tool that is configured to perform a fourth function, wherein the first tool, the second tool, the third tool, and the fourth tool couple together to form a single, unitary handheld housing, the first tool providing a base of the housing and the second tool providing a cover of the housing, wherein one or both of the third tool and the fourth tool is configured to be retained within the retaining chamber, and wherein the first tool, the second tool, the third tool, and the fourth tool are configured to separate from the housing, via snapable connections, for individual use.

17. The multi-purpose tool system of claim 16, wherein the first tool coupled to the fourth tool forms a first tool subassembly and the second tool coupled to the third tool forms a second tool subassembly, and wherein the first tool subassembly is removably coupled to the second tool subassembly.

18. The multi-purpose tool system of claim 16, wherein the first tool is configured as a prying tool and includes ramped prongs, the second tool is configured as a clawing tool and includes at least two arcuate claws separated by a gap, the third tool is configured as a magnifier, and the fourth tool is configured as a pick.

19. A multi-purpose tool system, comprising:

a first tool that is configured to perform a first function;

a second tool that is configured to perform a second function;

a third tool that is configured to perform a third function; and a fourth tool that is configured to perform a fourth function, wherein the first tool, the second tool, the third tool, and the fourth tool couple together to form a single, unitary handheld housing, wherein the first tool, the second tool, the third tool, and the fourth tool are configured to separate from the housing, via snapable connections, for individual use, and wherein at least the first tool and the second tool are configured to form a fifth tool that is configured to provide a support stand for a device, the support stand including the second tool secured to and reclined back relative to the first tool, the first tool including gripping peaks and valleys configured to provide different supporting positions for the device.

* * * * *